US007610859B1

(12) United States Patent
Dietrich

(10) Patent No.: US 7,610,859 B1
(45) Date of Patent: Nov. 3, 2009

(54) CARRIAGE ROTATABLE ROLLER COASTER TRACKS AND VEHICLES

(76) Inventor: Jordan Reder Dietrich, 4973 Havana Dr., Pittsburgh, PA (US) 15239

( * ) Notice: Subject to any disclaimer, the term of this patent is extended or adjusted under 35 U.S.C. 154(b) by 186 days.

(21) Appl. No.: 11/823,927

(22) Filed: Jun. 30, 2007

(51) Int. Cl.
*A63G 21/08* (2006.01)

(52) U.S. Cl. ..... 104/53; 104/56; 104/57; 104/63; 104/74

(58) Field of Classification Search ..... 104/53, 104/56, 57, 63, 74, 75, 76
See application file for complete search history.

(56) References Cited

U.S. PATENT DOCUMENTS

| | | | | |
|---|---|---|---|---|
| 2,535,862 | A | 12/1950 | Pewitt | |
| 3,451,161 | A | 6/1969 | Lemelson | |
| 3,610,160 | A | 10/1971 | Alimanestionu | |
| 4,034,678 | A | 7/1977 | Wilson | |
| 4,170,943 | A | 10/1979 | Achrekar | |
| 5,248,019 | A | 9/1993 | Sbarro | |
| 5,433,153 | A | 7/1995 | Yamada | |
| 5,791,254 | A | 8/1998 | Mares et al. | |
| 6,047,645 | A | 4/2000 | Cornwell et al. | |
| 6,095,926 | A | 8/2000 | Hettema | |
| 6,158,354 | A | 12/2000 | Eiraku | |
| 6,220,171 | B1 | 4/2001 | Hettema et al. | |
| 6,405,655 | B1 | 6/2002 | Clerx | |
| 6,513,441 | B1 | 2/2003 | Clerx et al. | |
| 6,523,479 | B1 | 2/2003 | Schilke et al. | |
| 6,606,953 | B2 | 8/2003 | Mares | |
| 2006/0137563 | A1 * | 6/2006 | Cummins | 104/53 |
| 2006/0178221 | A1 | 8/2006 | Threlket | |
| 2007/0089630 | A1 | 4/2007 | Gordon | |

* cited by examiner

*Primary Examiner*—S. Joseph Morano
*Assistant Examiner*—Zachary Kuhfuss

(57) ABSTRACT

An improved roller coaster system having one or more tracks that may exist in differing orientations on one support spine or equivalent supporting structure. Passengers may be rotated independently of the orientation of the tracks an essentially unlimited amount of times in either direction about predetermined axes utilizing inertia as the motive force. If multiple tracks are used, each may run separately from the others in portions of the circuit to provide unique track elements for each set of riders. Furthermore, each track may have its orientation and position relative to the support system exchanged with other tracks in the system.

9 Claims, 16 Drawing Sheets

CARRIAGE ROTATABLE ROLLER COASTER TRACKS AND VEHICLES

CROSS-REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

The present invention relates to amusement rides and particularly relates to roller coasters that depart from the usual track configuration.

2. Prior Art

Since the early days of roller coasters, manufacturers have experimented with variations of a central theme, which is to provide amusement to passengers seated inside, on top of, on the side of, or under cars or assemblies coupled to tracks for movement thereon. Whether or not the passenger vehicle assumes the standard railway car configuration, the general effect attained is to statically couple passengers to their cars. Passengers are therefore carried through the same motions as the cars in which they ride and experience essentially the same gravitational forces that act upon the cars. See, for example, U.S. Pat. Nos. 4,531,459, 5,272,984, 5,463,962, and 5,595,121, the disclosures of which are incorporated herein by reference. Passengers using the referenced inventions are rotated only when the tracks upon which they ride change orientation.

Some amusement devices, including roller coasters, attempt to deliver additional systems of rotation. See, for example, U.S. Pat. Nos. 142,605, 567,861, 2,535,862, 3,610,160, 5,433,153, 5,791,254, 6,095,926, 6,098,549, 6,158,354, 6,220,171, 6,227,121, 6,386,115, 6,405,655, 6,477,961, 6,513,441, 6,606,953, the disclosures of which are incorporated herein by reference. These known amusement devices are limited in their abilities and functions in that they do not allow for a passenger to rotate independently from the track orientation without the application of additional energy. Rather than derive such rotation from the track configuration, they require electrical, hydraulic, or pneumatic devices or direct gravitational force to rotate or right the passenger.

U.S. Pat. No. 6,523,479, the disclosure of which is incorporated herein by reference, allows for rotations of passengers based on track configuration via rails that at predetermined portions of the circuit become "displaced". However, these passengers, after having been rotated, must again be rotated to their original orientation to enable them to exit the ride from an upright position. Furthermore, the referenced art does not depict or suggest a roller coaster or similar device that does not travel upon the rail or rails that induce rotation, meaning that more than the usual amount of bogies or wheel assemblies and accompanying structures are most likely needed to allow the prior art to function. These limitations most likely result in heavier, bulkier, and more costly than necessary vehicle assemblies and track structures. Also, the loss of kinetic energy due to unnecessary friction from constant contact of extra wheels with a rail or rails for the duration of a ride may limit the possible track configurations. In the prior art, only "rails" are described and depicted as the means for causing rotation that is independent of the track, and nothing else is suggested or implied as a means to cause such rotation. Yet another significant limitation is the prior art's inability to rotate passengers independently of the track more than a limited amount of degrees, such as the stated "720 degrees". This is because there is a limit to how far the mechanical devices of the train can be moved by the displaced rail(s).

U.S. Pat. No. 4,170,943, the disclosure of which is incorporated herein by reference, is a coaster that can rotate passengers only 180 degrees on the vertical axis independently of the track orientation.

U.S. Pat. No. 6,047,645, the disclosure of which is incorporated herein by reference, are coasters that allow passengers to travel on two opposite sides of one track system but do not allow for controlled passenger rotations independent of the tracks.

My own U.S. patent application Ser. No. 11/448,654, the disclosure of which is incorporated herein by reference, is a roller coaster that uses control bars at predetermined points along the track to rotate passengers on a horizontal axis that is perpendicular to the track. The control bars are not continuous stationary control structures and are designed to rotate passengers a predetermined amount.

In the non-preferred embodiment of U.S. Pat. Application Publication # US 2006/0178221 A1, the disclosure of which is incorporated herein by reference, passengers may be rotated about at least two axes by a complicated gear assembly including a "toothed rack or the like" that may interact with "cam followers sector gears or the like placed on the track system". It was not indicated or suggested in the prior art that the rotation of passengers could be derived through a simple mechanical linkage such as an element that is rotated directly by the track assembly which element which element then rotates passenger's seating by way of a suitable linkage. Furthermore, it did not suggest the possibility of deriving rotation from track mounted structures with simple, unvarying cross-sections such as a channel, slot, groove, rail, or bar.

In U.S. Pat. Application Publication # US 2007/0089632 A1, US 2007/0089631 A1, and US 2007/0089630 A1, the disclosures of which are incorporated herein by reference, more than two trains on more than two tracks are described, but each track has its own support spine or equivalent element which it does not share with other tracks.

U.S. Pat. Nos. 3,451,161 and 4,034,678, the disclosures of which are incorporated herein by reference, are toy systems that allow more than one ornament to travel simultaneously at a point along a track system, but they have limitations that obviously do not permit a human passenger. Furthermore, these referenced inventions do not right the ornament(s) while inverted.

SUMMARY

The present invention includes improved roller coaster systems and similar devices that allow passengers to travel on a track having varying configuration while remaining head-up. The present invention also includes improved roller coaster systems and similar devices that allow passengers to travel on one track of a track system while other passengers simultaneously travel on separate tracks of the same track system.

The present invention comprises a track system that includes at least one but preferably three tracks each including a support system. In predetermined points along the tracks, the track's spine or equivalent supporting elements may combine into one merged support portion whereupon all tracks can be supported. An advantage of the present invention, aside from its uniqueness, is that potentially three times as many passengers could simultaneously ride the invention as compared with prior art (on separate tracks within the system). This tripled capacity could reduce the usual time a passenger waits to board by about two-thirds. An additional advantage of the invention is that it provides a means for constructing more than two separate tracks using support system elements such as a spine that are common to all of the tracks, resulting in very substantial cost savings over three prior art tracks. These support elements may also provide support or mounting surfaces for other elements of the invention such as brakes, propulsion devices, and control channels as will be described below. The present invention further comprises carriages which include seating for a plurality of passengers and vehicles for coupling the carriages to the tracks for movement thereon. The first embodiment of the invention allows for each passenger to rotate about an axis which is parallel with respect to the direction of travel (hereafter referred to as the horizontal axis). The first embodiment accomplishes such rotation solely by utilizing the forward motion of the train (the term "train" indicating vehicles and carriages that are linked and all elements mounted thereon). Such rotation may occur at many predetermined points along the tracks. For example, such rotation would preferably keep passengers upright for most of a ride regardless of the orientations of the vehicles. The present invention provides the advantage of inducing rotations by utilizing a simple mechanical linkage without the application of any electricity or force other than the inertia of the trains and passengers. Another advantage of the first embodiment of the invention is that the carriages, after having been rotated, do not necessarily need to be rotated to their original orientations with respect to the vehicles to allow passengers to exit the train from an upright position. Because of its relative simplicity, the present invention may retain more inertia, require significantly less maintenance, and reduce occurrences of non-operation compared with prior art rides that rotate passengers independent of their tracks. It would also likely have a significantly smaller cost than prior art with multiple tracks which could not all operate on one track system.

A distinct and novel advantage of the first embodiment is that it allows passengers to experience various different vehicle orientations, such as being on the side of the track, then above the track, then below the track, while remaining substantially head-up. It is likened to riding different types of roller coasters, the exciting transitions between them not requiring passengers to exit the carriages and wait in lines. Passengers will likely choose to ride more than once to experience the variety of track configurations.

DRAWING FIGURES

DESCRIPTION

Figure 1:
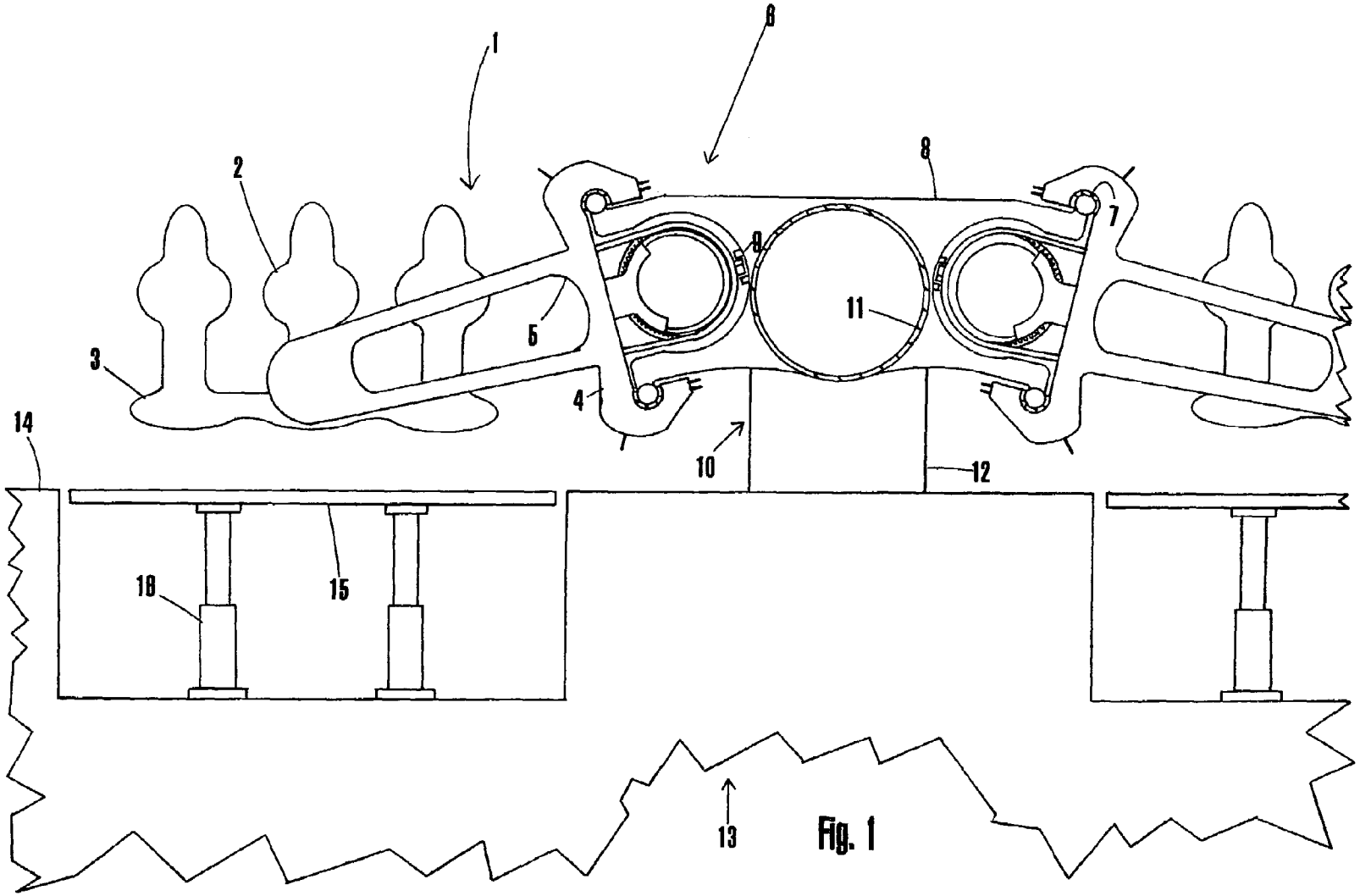
FIG. 1 is a rear view of two trains, tracks, and portions of a loading station.

In order that the above-recited advantages and features of the invention may be thoroughly understood, a more specific and detailed description of the embodiments summarized above will be rendered by reference to the accompanying drawings. These drawings provide only selected embodiments of the invention and are not therefore to be considered limiting of its scope. Also, the skilled artisan would understand that the invention can be practiced without employing these specific details. Indeed, the essence of the invention can still be practiced while modifying the illustrated train and track system. FIGS. 1 through 16 provide a better understanding of the invention by depicting a device made according to the first embodiment. With reference to FIG. 1, a train 1 includes carriages 2 that include seats 3 with restraining devices (not shown) common in the art that may include shoulder harnesses, lap bars, seat belts, or a combination of those or other elements to securely, safely, and comfortably maintain passengers in the carriages despite the orientation of the carriages and the forces acting upon them. The train further includes vehicles 4 (shown here in sideways positions) that are encased in a protective, aerodynamic outer shell 5 or fairing. The vehicles 4 include constructions (shown later) for safely, securely, and movably coupling the train 1 to the tracks 6. The vehicles 4 also include internal constructions (shown later) for rotating the carriages 2 as these constructions interact with elements of the tracks 6 as will be described below. The tracks 6 include preferably two rails 7 per train, rail supports 8, and control channels 9 that are fused to the rail supports 8. The tracks are held securely in place by way of support systems 10 that preferably include contiguous supports 11 that run the length of the tracks 6 and set-in-ground supports 12 that are fixed to the contiguous supports 11. The reader should note that in FIG. 1, as well as FIGS. 2, 8, 9, 14, 15, and 16, to which the reader will later be referred, the rails 7, control channels 9, and contiguous supports 11 are depicted in cross section. The contiguous support 11 depicted is a steel tube, but the artisan may replace this spine type track with skeleton (truss), triangle, or box type tracks or with other elements if he or she deems them to be safe, secure, and preferable. The remainder of the support system 10 includes elements common in the art that may include mainly steel tubes, cement pylons (not shown) and at certain places along the track, such as lift hills, truss assemblies (not shown). The support system will also provide support and mounting surfaces for elements common in the art, and therefore not depicted, such as linear induction motors, linear synchronous motors, pneumatic or hydraulic devices, rotating "launch" wheels, chain lifts, and brakes. These elements will interact with elements mounted on the vehicles as will be described below.

A loading station 13 includes an immovable portion 14 where passengers would wait to board and a movable platform 15 whereupon passengers would walk when it is time to board the trains 1. The movable platform could be a solid unbroken platform except for some holes large enough to allow the set-in-ground supports 12 to stick up through. It is raised by hydraulic devices 16 (or other devices such as scissor jacks) to allow passengers to board, and it is lowered by the same devices so as to not interfere with passengers' feet as the trains 1 depart. The reader should note that in this embodiment, a third train (not shown) on a separate contiguous support and in a similar arrangement as one of the depicted trains 1 would appear to the right of the FIG. 1*f* the margins were to be extended. As the trains 1 depart the loading station 13 they are either "launched" forward by methods known in the art or are allowed to coast out of the station to later be hoisted up a lift hill (not shown) to obtain the energy from which they will derive their speed.

Figure 2:
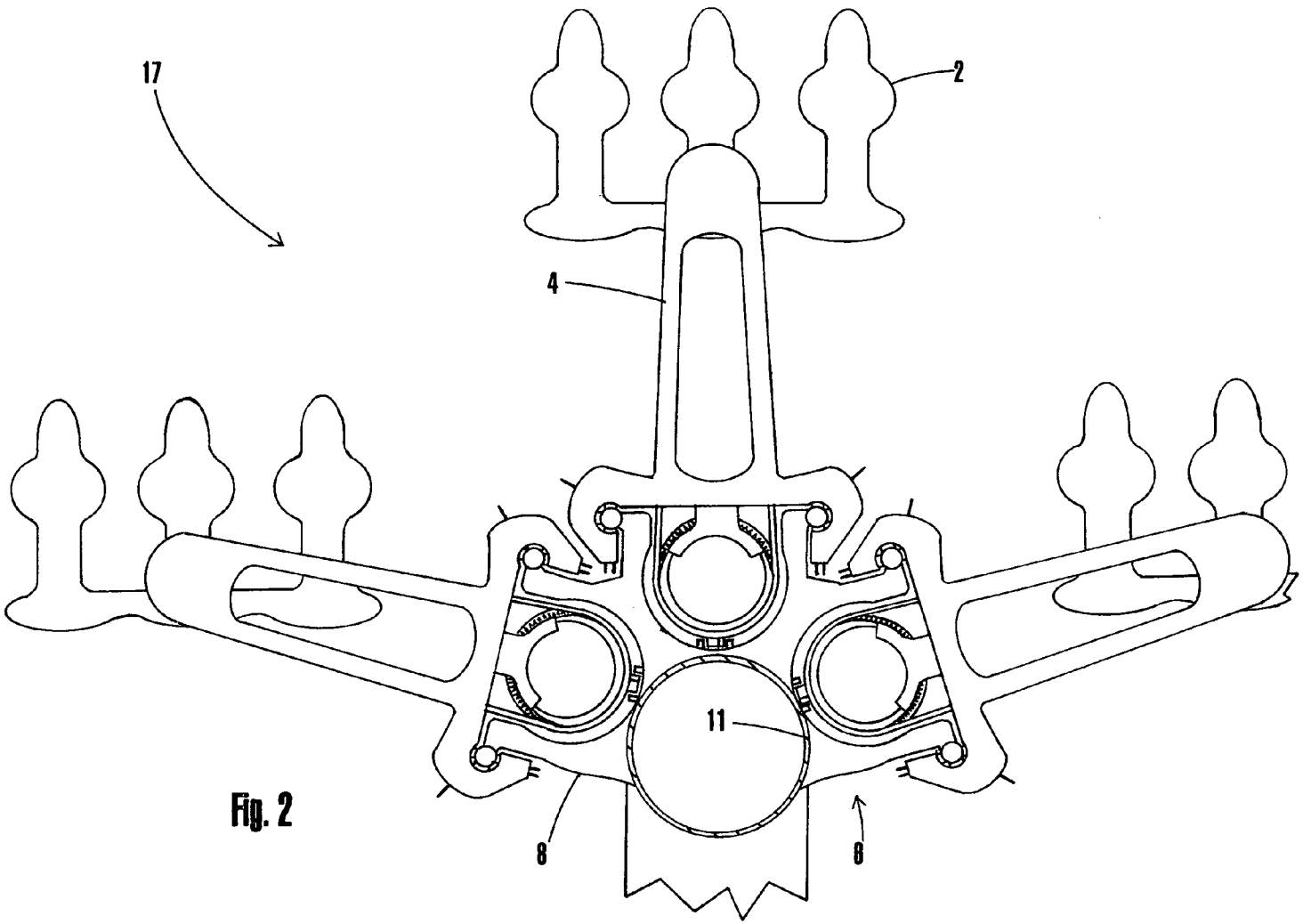
FIG. 2 is a rear view of trains as they ride together on a merged support portion.
Figure 3:
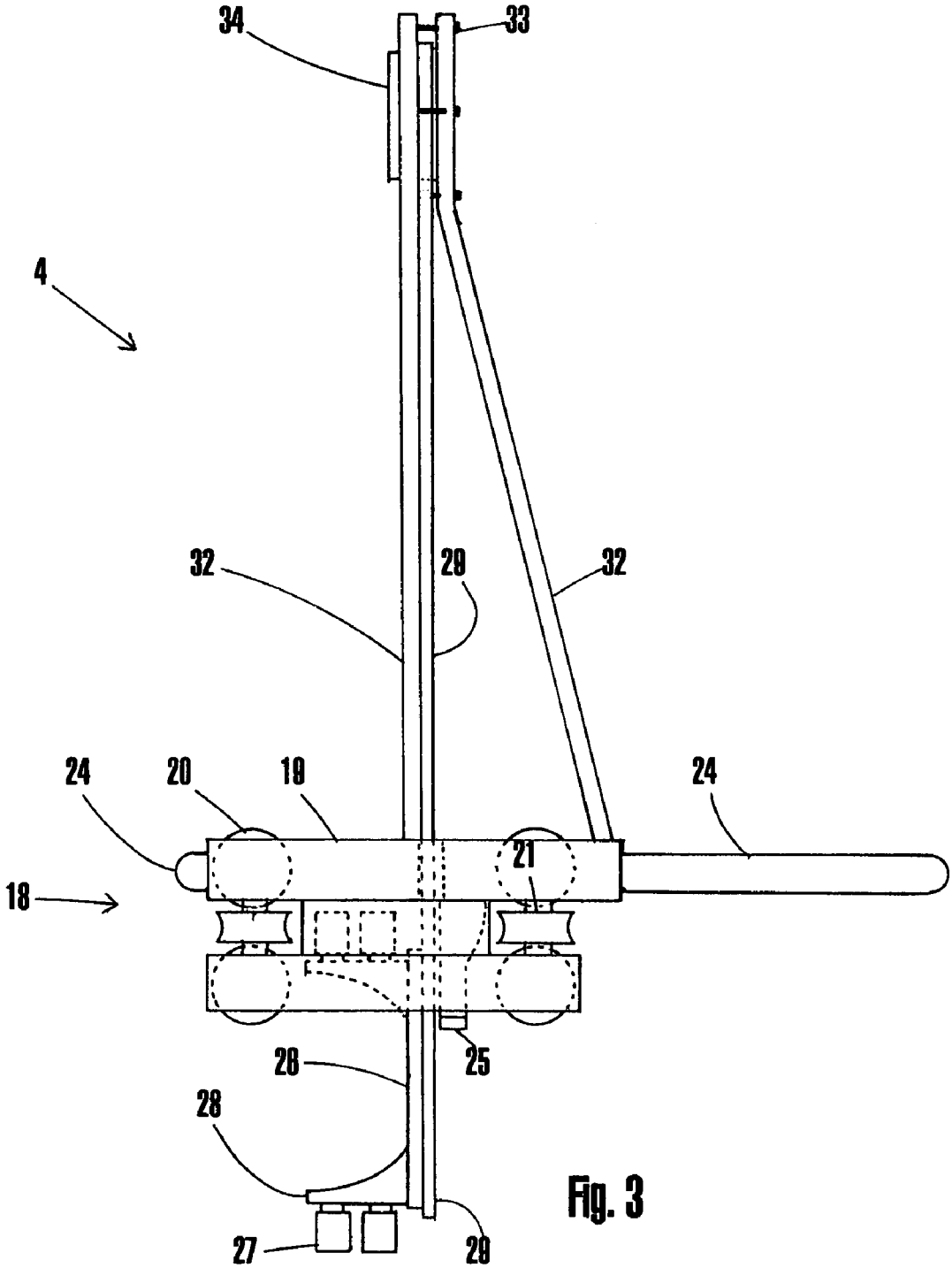
FIG. 3 is a side view of a vehicle.
Figure 4:
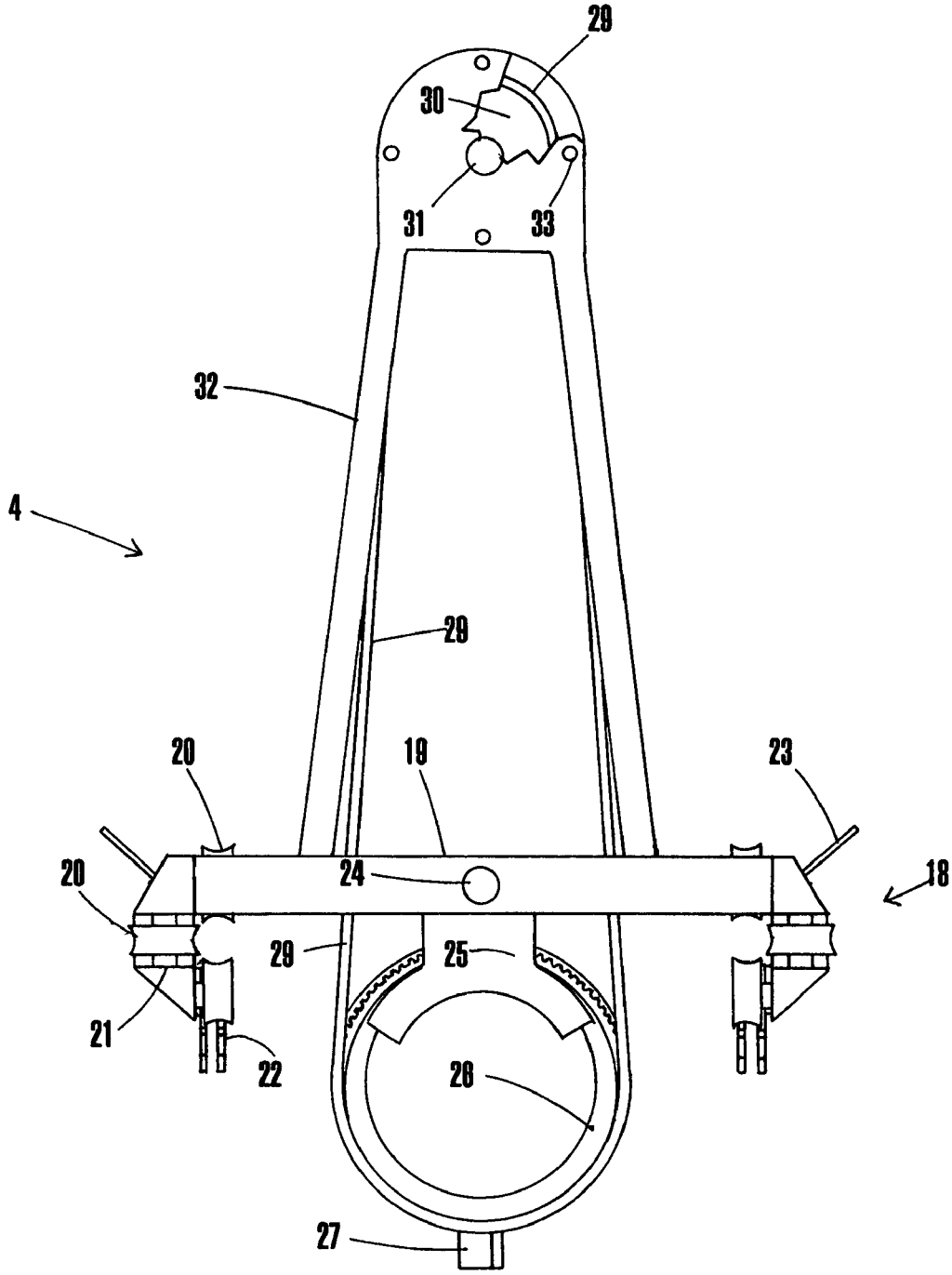
FIG. 4 is a rear view of a vehicle.
Figure 5:
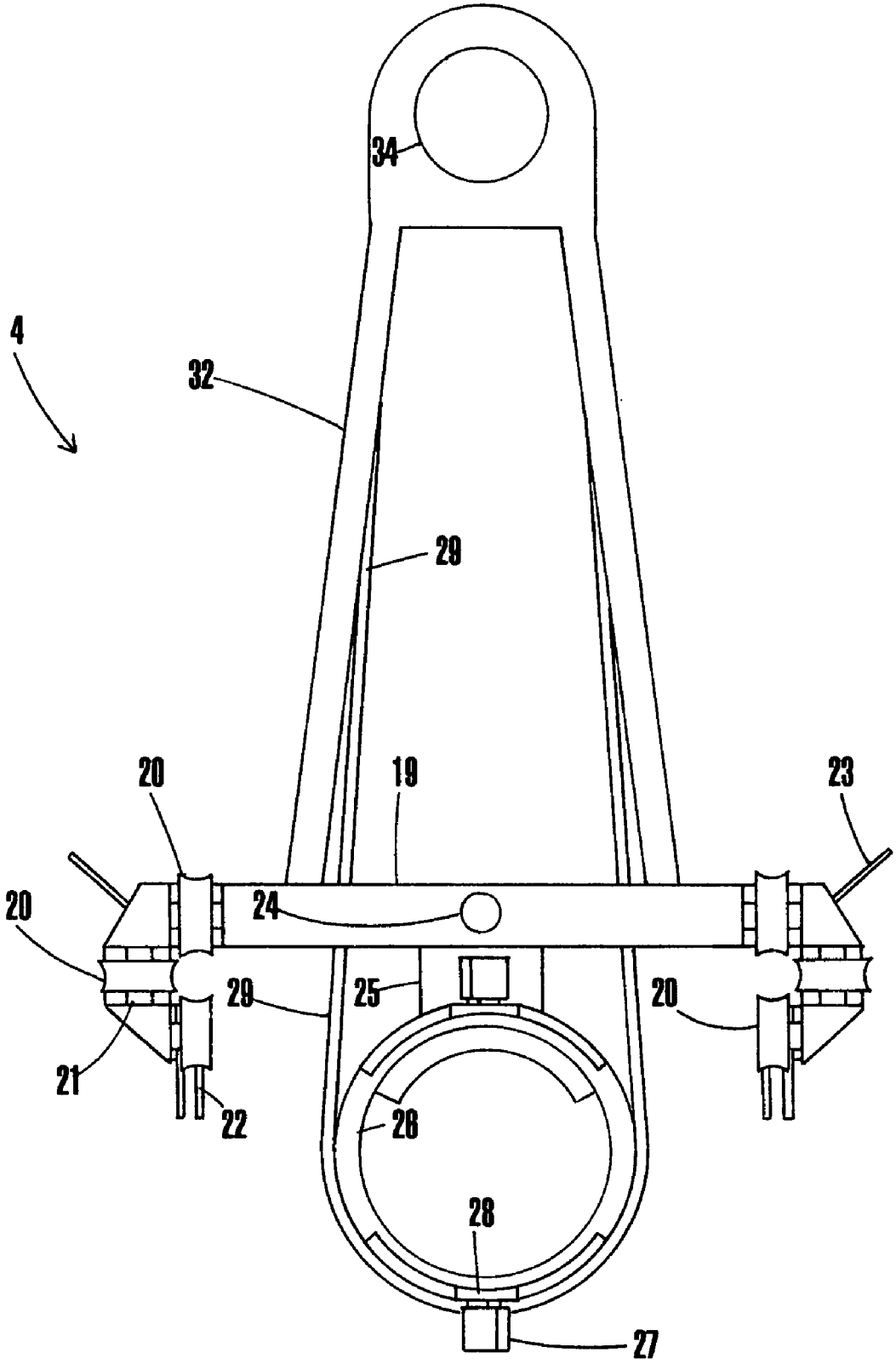
FIG. 5 is a front view of a vehicle.
Figure 6:
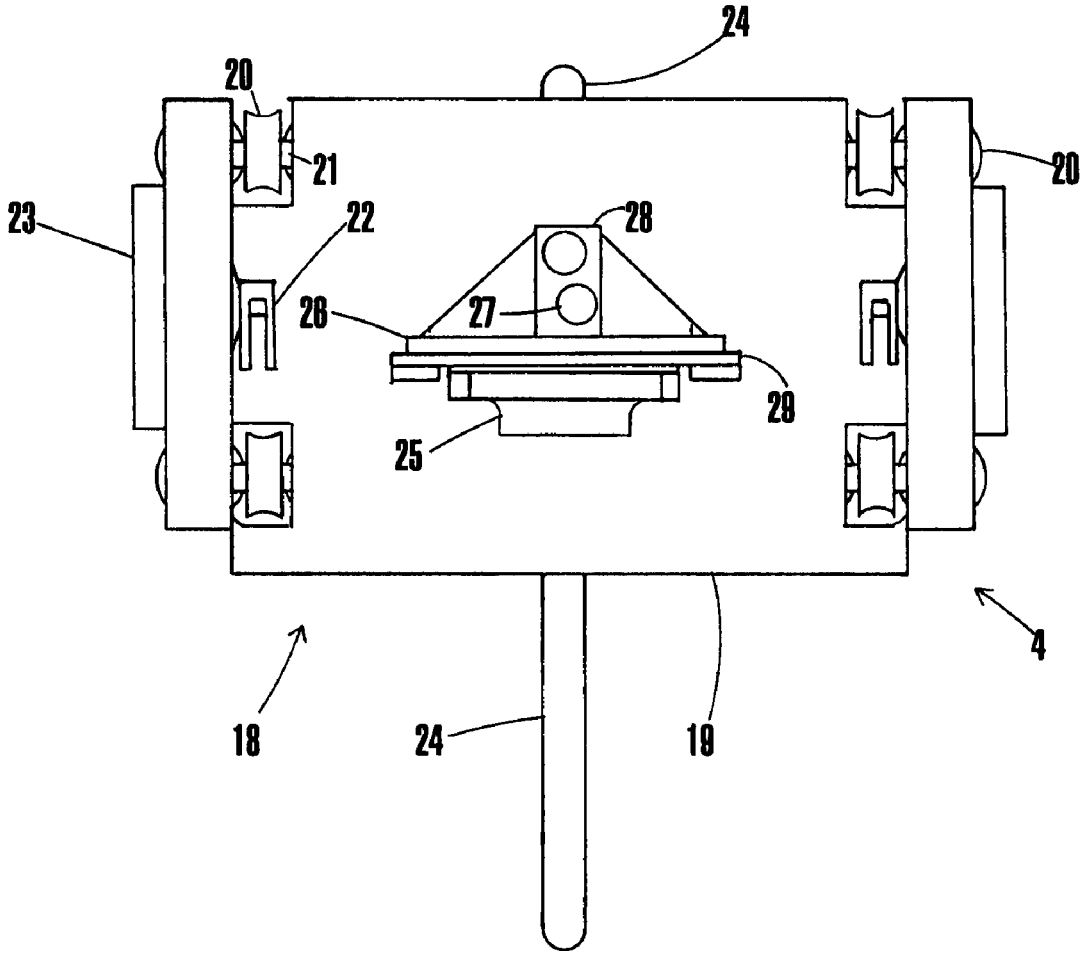
FIG. 6 is a bottom view of a vehicle.
Figure 7:
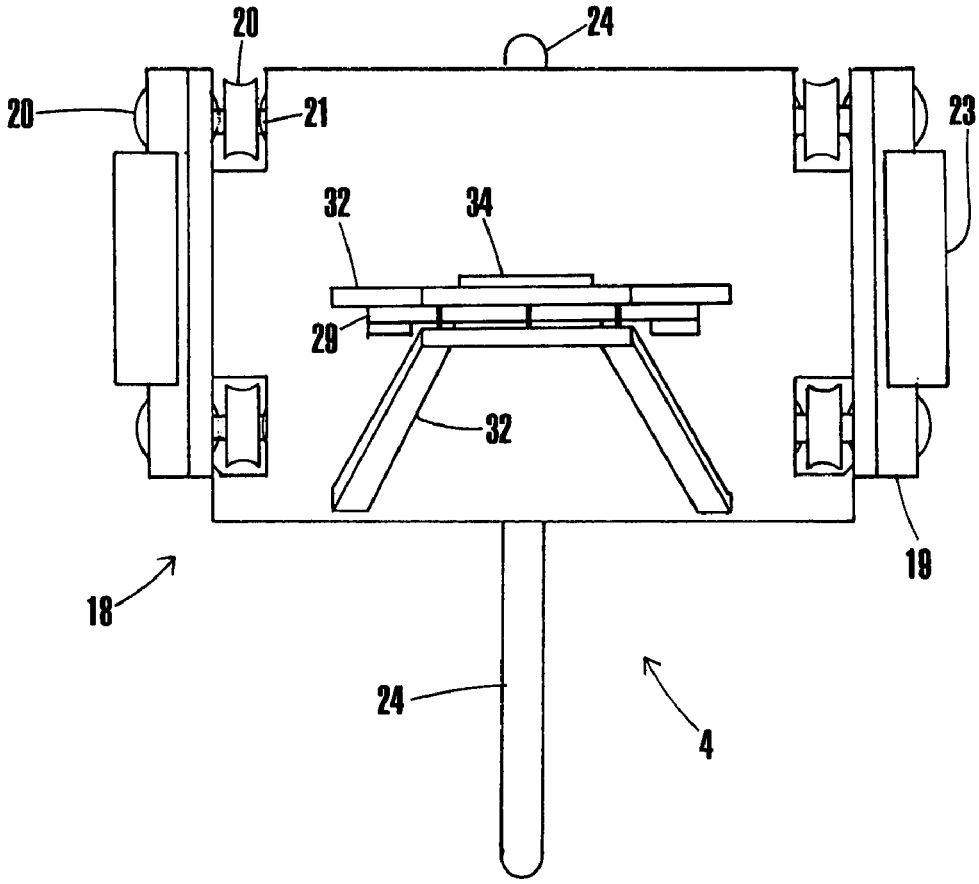
FIG. 7 is a top view of a vehicle.

With reference now to FIG. 2, after the trains have been brought up to speed, the tracks 6 (preferably three) form a merged support portion 17 as each track's contiguous support (or an equivalent) is merged with the others to allow all tracks to be supported by one contiguous support 11. Also the rail supports 8 in the merged support portions 17 could be manufactured as combined pieces to further reduce weight and cost. A tremendous advantage of the merged support portions is that they would likely reduce the manufacturing and maintenance costs of three roller coasters tracks to the extent that these costs would more closely match the cost of one roller coaster of prior art.

As the vehicles 4 change from their original orientations to the orientations depicted in FIG. 2, the carriages 2 may be rotated with respect to the tracks 6 by the earlier-mentioned internal constructions of the vehicles 4 to enable the passengers to remain head-up.

The reader is now referred to FIGS. 3-7, five orthogonal views of a vehicle of the invention. The reader should note that FIGS. 3-7 appear twice as large as the other drawing figures and are depicted without the shell or fairing shown in the other figures. Also, to provide a comprehendible view of the internal parts of the vehicle, the interactive structures for receiving propulsion and braking in FIG. 4 have been removed from the figure and hidden parts are depicted with phantom lines. The vehicle 4 shown here includes a bogey 18 to allow the vehicle 4 to securely run along the rails (not shown) in any orientation with respect to the ground, including sideways or upside-down. The bogey 18 includes a sturdy base 19, wheels 20, and shafts 21 of the wheels 20. The bogey 18 should be made exceptionally strong using known methods in the art.

The base 19 serves as a sturdy mounting surface for interactive elements for braking and propulsion such as fin brakes, ratchet or tow dogs, or linear induction motors. In FIGS. 4-7, elements depicted for propulsion are tow dogs 22 and the elements depicted for braking are brake fins 23. The selection and placement of elements in these mounting sections will depend in part on what the artisan desires the riders experience to be. It may also be possible to place braking systems on the underside of the base 19 in close proximity to the wheels 20. A jointed linkage 24 to other vehicles, here represented only as a bar, should be more than adequately strong with known methods in the art. The base 19 also serves as a mounting surface for devices that cause the rotation of the carriages. A gear mount 25, including a rigid and strong semi-circular inner track (not shown) with a predetermined shape is fixed to the base 19. A hubless orbital gear 26 includes a rim (not shown) that seats securely and slidably into the inner track of the gear mount. A similar arrangement can be seen on the back wheel of the motorcycle depicted in U.S. Pat. No. 5,248,019, the disclosure of which is incorporated herein by reference. On opposite edges of the orbital gear 26 are two sets of strong rollers 27 on supports 28. Considering the need to allow the rollers 27 an unimpeded 360 degrees of revolution will help the artisan construct the rollers 27, supports 28, and orbital gear 26 in the correct sizes and shapes. A chain 29 connects the orbital gear 26 with a carriage turning gear 30 the shaft 31 of which is seated securely and rotatably into two frames 32 that are preferably coupled with bolts 33. The frame 32 is fixed to the base 19 in an arrangement strong enough to safely withstand forces from the carriage (shown in other figures) and the carriage turning gear 30. The frame 32 needs to be of sufficient length to prevent undesirable contact of passengers' hands or other body parts with the vehicle 4. The necessary length depends in part on the chosen selection of passenger restraining devices. The shaft 31 of the carriage turning gear 30 ends in a plate 34 whereupon the carriage (shown in other figures) may be securely coupled preferably near the center of the combined mass of the carriage and passengers.

Figure 8:
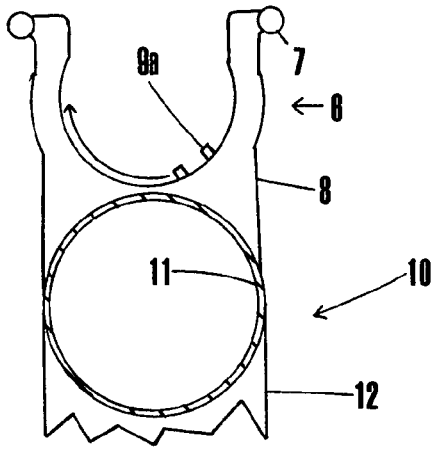
FIG. 8 is a rear view of a track.
Figure 9:
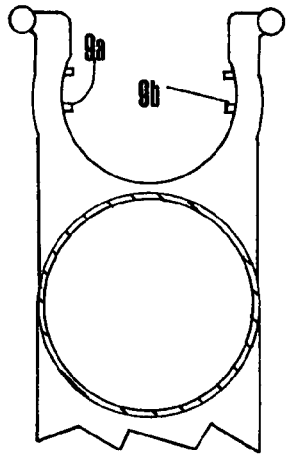
FIG. 9 is a rear view of a track.
Figure 10:
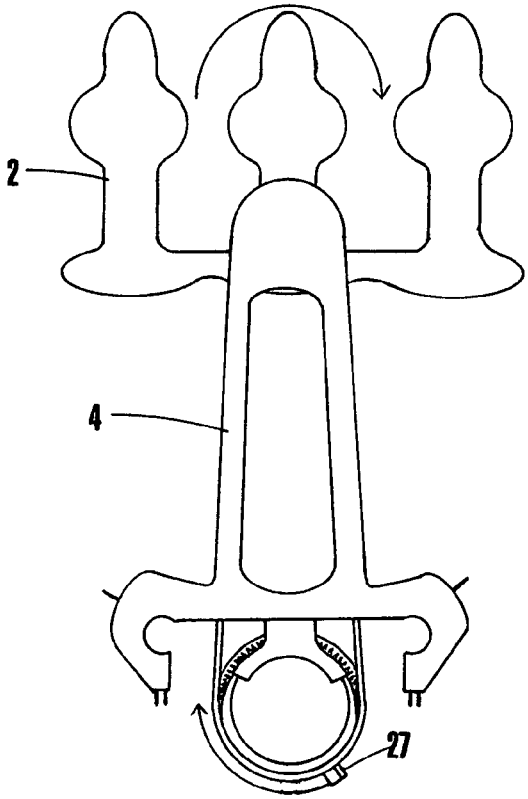
FIG. 10 is a rear view of a vehicle.

Referring now to FIG. 8, a track 6 including rails 7, a rail support 8, and one of the control channels 9*a*, and the track's support system 10 including the contiguous support 11 and a set-in-ground support 12 are depicted. The reader should note that the part of the rail support 8 to which the control channel 9*a* is fused forms a semi-circle. The control channel 9*a* does not precisely follow the path of the rails 7. Rather than being a straight bar, it is curved in a manner that, when viewed from the rear, its cross-section changes position relative to the track as the vehicle (shown in other figures) progresses along the track. An arrow indicates one such possible change of position. The reader is now referred to FIG. 9 which shows the same elements as does FIG. 8 with the addition of another control channel 9*b*. As the cross section of control channel 9*a* has changed from its position in FIG. 8 to the position it occupies in FIG. 9 the vehicle (shown in other figures) would have encountered control channel 9*b*. FIG. 10 indicates what would happen to one of the carriages 2 and vehicles 4 as a result of the change of position of portions of the control channels 9*a* and 9*b* that the rollers 27 would encounter if they had progressed along the portions of the track 6 depicted in FIGS. 8 and 9. Rollers 27 are situated between the sides of the control channel 9*a* seen in FIG. 8. To enable each roller 27 to contact an opposite side of the channel 9*a* and rotate in opposite directions (to reduce friction) the center of each roller 27 would be close to the centerline of the control channel 9*a* on opposite sides thereof (offset). By making the control channels 9 very slightly wider than the space taken up by the rollers 27, it may create an additional inertia conserving advantage over the prior art by only permitting one roller 27 at a time to contact the channels 9 and in certain brief moments such as rotation direction changes no part of the vehicle 4 would contact the control channels 9. Continuing to refer to FIGS. 8-10 while considering the elements depicted in FIGS. 3-7, as the vehicle 4 progresses along the portion of track 6 in FIG. 8 to the portion in FIG. 9 the cross section of control channel 9*a* changes position relative to the track 6 forcing its side against one of the rollers 27. As the rollers 27 are forced to move, the orbital gear 26, chain 29, carriage-turning gear 30, and carriage 2 are likewise forced to move smoothly clockwise (if viewed from the rear). If the control channels 9*a* and 9*b* in FIG. 9 were to continue to change position clockwise by 180 degrees, control channel 9*a* would end and as control channel 9*b* approaches the position that control channel 9*a* was previously in, another control channel (not shown) that may have a slightly widened and very gradually inward tapering mouth or a chamfer would smoothly come to be securely closed in on the sides of the rollers 27 where control channel 9*b* was positioned in FIG. 9. By this system of corresponding control channels 9 carriages can be made to turn numerous full rotations in either direction about the horizontal axis, limited only by the inertia of the train and passengers.

Figure 11:
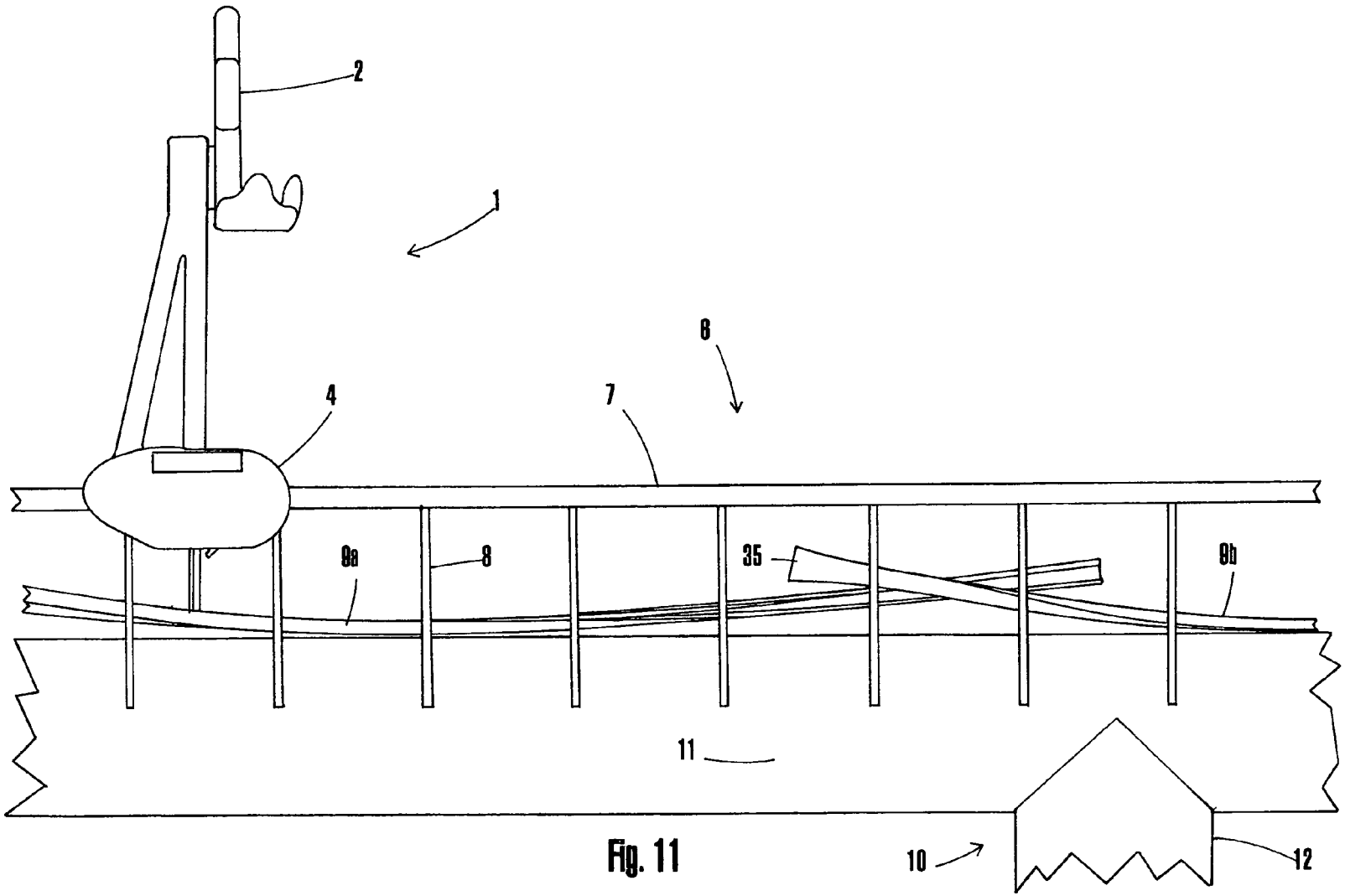
FIG. 11 is a side view of part of a train on a track.
Figure 12:
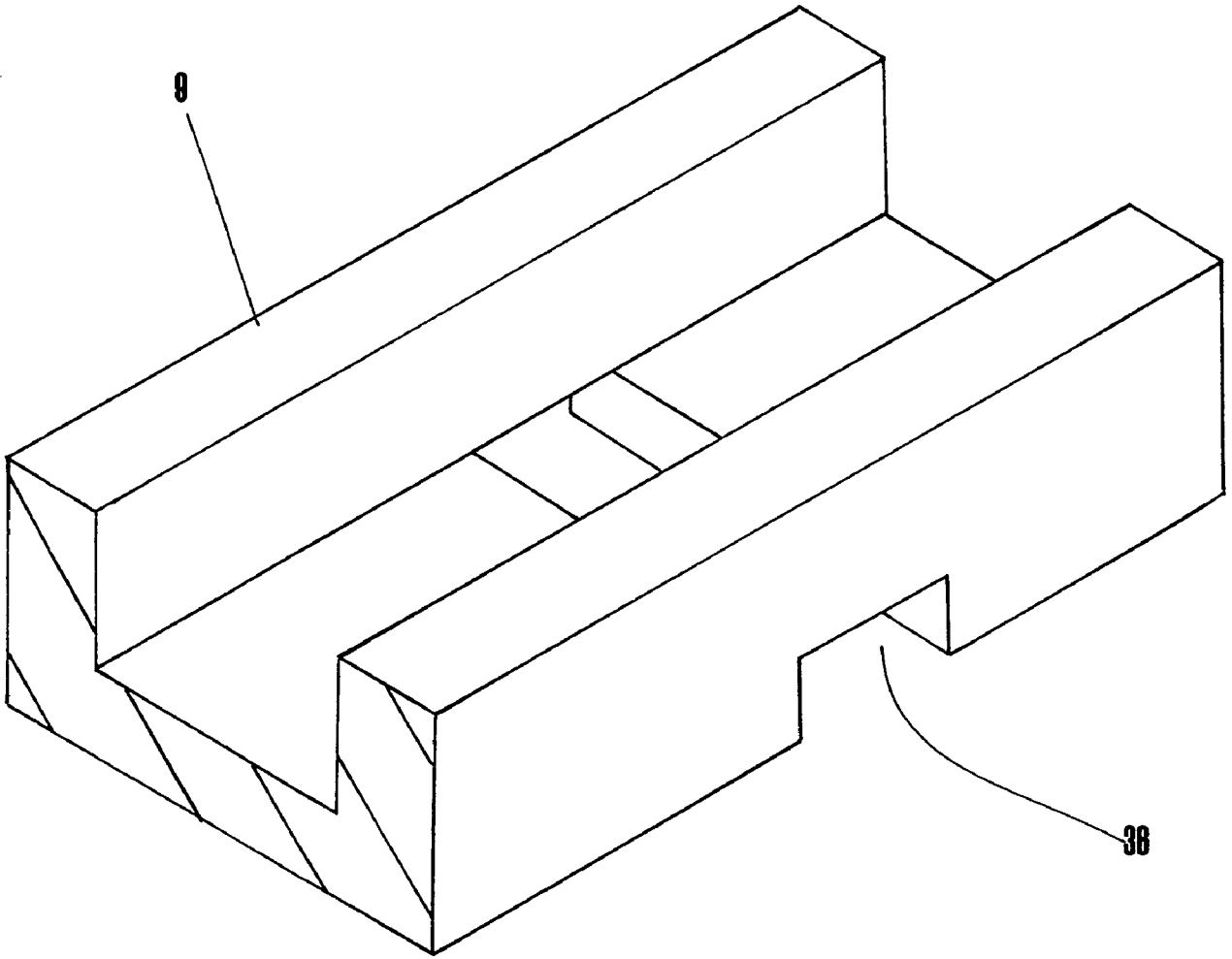
FIG. 12 is an enlarged elevated perspective view of a short section of a control channel.

Additional understanding of the function of the rotation imparting elements may be rendered by reference to FIG. 11 which depicts part of a train, a track 6 including rails 7, a rail support 8, and control channels 9*a* and 9*b*, and the track's support system 10 including the contiguous support 11 and a set-in-ground support 12. An exaggerated widened mouth 35 of control channel 9*b* is depicted. The general shape of the control bars in this embodiment is depicted in FIG. 12. The section of the control channel 9 shown is designed to be strong and stable without taking up more than a necessary amount of space between vehicles (not shown) and rail supports (not shown) as is evidenced by the notches 36 that rail supports would seat into. Referring back to FIG. 11, the depicted vehicle 4 is substantially at the point along the track 6 that is illustrated in FIG. 8. The portion where, from the reader's perspective, the two control channels 9*a* and 9*b* cross is depicted substantially in FIG. 9 As the train progresses in the direction of travel, the control channels 9*a* and 9*b* force the rotation of the carriage 2 in the manner described above. Obviously, this "extra dimension" of movement should not only be used to maintain passengers in head-up positions as the tracks changes orientation, but it should also be used to used to endeavor to bewilder, amuse, and excite passengers by using rotation derived from track orientation and rotation derived from the novel constructions described above simultaneously as described in some examples below.

Figure 13:
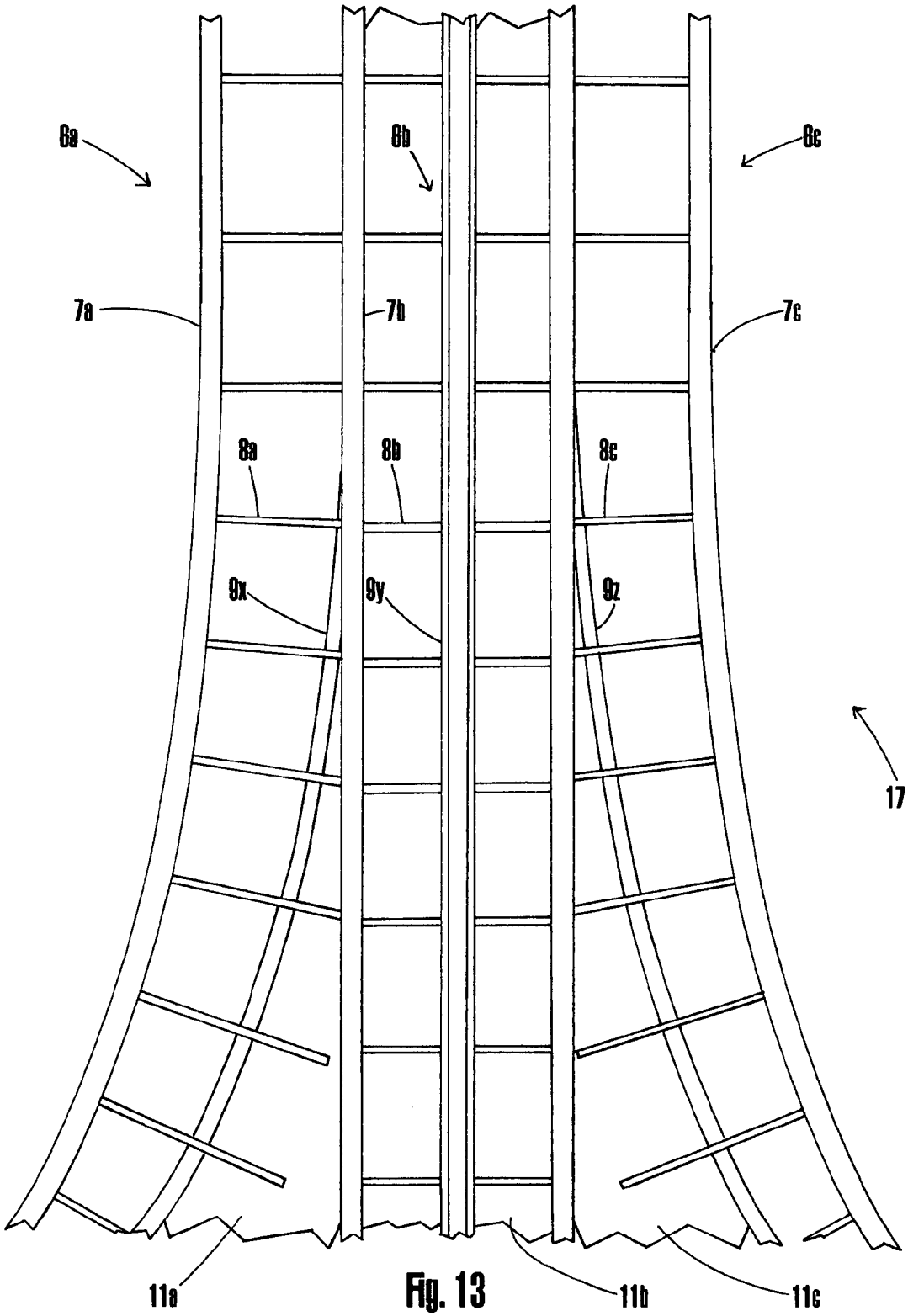
FIG. 13 is a top view of three contiguous supports merging into one and their accompanying tracks.

Referring to FIG. 13, a view of a merged support portion 17 including three tracks 6*a*, 6*b*, and 6*c* and three contiguous supports 11*a*, 11*b*, and 11*c* is given from above to augment the reader's understanding of this embodiment. Note that while the three contiguous supports 11*a*, 11*b*, and 11*c* and several of the rail supports 8*a*, 8*b*, and 8*c* merge into one, there remain three pairs of rails 7*a*, 7*b*, and 7*c* and accompanying control bars 9*x*, 9*y*, and 9*z*.

Figure 14:
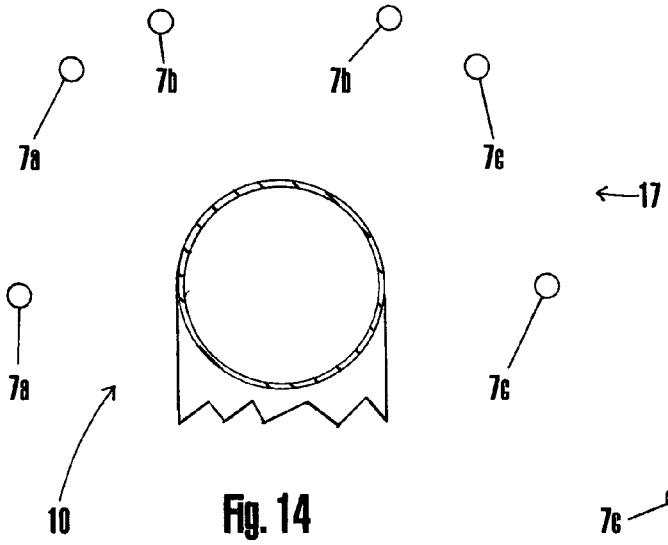
FIG. 14 is a rear view of rails and a contiguous support.
Figure 15:
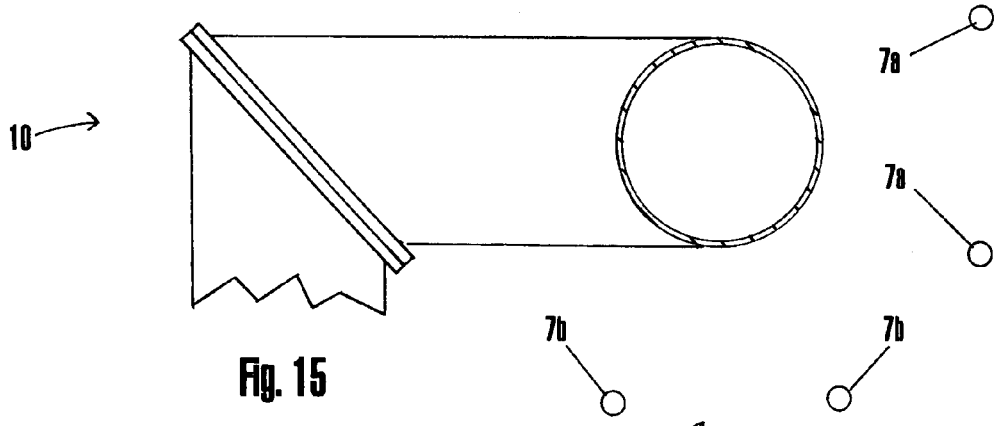
FIG. 15 is a rear view of rails and a contiguous support.
Figure 16:
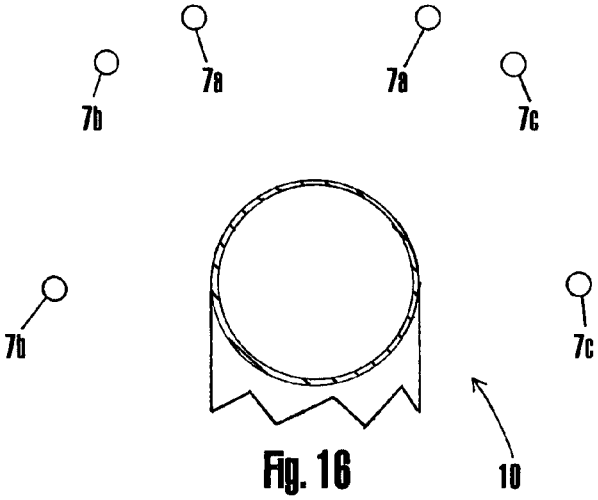
FIG. 16 is a rear view of rails and a contiguous support.

An advantage of the embodiment is that it offers added possibilities for track layouts. With reference now to FIGS. 14-16, which depict a possible layout of rails 7 and support systems 10, FIG. 14 indicates an initial position of the rails 7 of a merged support portion 17. At some point, each of the three sets of rails 7*a*, 7*b*, and 7*c* separate from the merged support portion 17 and go their separate ways, forming inversion and other elements that differ from the other tracks. Because the passengers can be turned upright (or vice-versa) independently of the orientation of the rails, the three sets of rails 7*a*, 7*b*, and 7*c* can once again form a merged support portion 17 in positions and orientations differing from those where they un-merged, as is depicted in FIG. 15. Such separating and merging (an additional example is indicated in FIG. 16) can occur as few or as many times as the artisan desires, limited only by the inertia or kinetic energy of the train and passengers. By putting distinct differences in the three tracks, the artisan would encourage riders to ride several times, each time from a different starting track. Because the passenger can always be turned upright via control channels with predetermined shapes the vehicles may run along the track at any angle with respect to the main support tubes including upside-down for extended periods. For example, a track may be designed in a manner that in a portion of the track the carriages would spiral around the main support tube clockwise while spinning counter-clockwise. Otherwise, a track may be designed in a manner that a portion of the track rotates clockwise and the carriages also rotate clockwise, intensifying the effect. A rotation during an inversion would likely be particularly thrilling and disorienting.

Yet another unique and fascinating advantage of this system is that the starting and ending positions of trains and tracks do not necessarily need to be the same. Because the vehicles could adopt the starting orientation of a vehicle from a separate track if made to run upon it, in an additional embodiment the artisan could route the rails in a manner (connecting or combining two or more tracks into one) that a train would come to rest occupying a different section of track in the loading station than that which it began from. This is an advantage not only because it would likely be very interesting to passengers, but also because the artisan has the option of allowing the trains, after completing the circuit once, to coast through the loading station without coming to a stop so that the passengers may enjoy yet another unique circuit. This continuation or connection could be done with two tracks or three or with additional tracks, thus making all the tracks into one. This idea of connecting tracks or routing a tracks so that it appears to be two tracks in the loading station was done in three pre-steel tube era "moebius" roller coasters (they are not truly of moebius configuration) but it has never been done with three tracks and never been done in such a potentially exciting way. In an additional embodiment the artisan also has the option of making a track system that has more than three tracks, some being supported on one merged support portion and others being supported on another merged support portion in a manner that some tracks may eventually switch places with those from the other set. In an additional embodiment a track is routed in a manner as described above that it appears to be more than three tracks. Indeed, using the technology here described, the number of tracks in a roller coaster system and the manner of their routing is limited only by available resources, space, skill, and imagination.

I have designed the first embodiment in such a way that it may be controlled without a supply of anything such as electricity or hydraulic or air pressure to the trains and I prefer for it to remain so. Compared to roller coaster trains having the above-mentioned provisions to cause rotations, the present invention has the advantages that it would likely be easier to construct and maintain and it would likely be less prone to failure, and therefore likely save the cost of more frequent servicing. However, other embodiments can be made to use prior art devices such as ones that are electrical, hydraulic, pneumatic, or engine driven to induce rotations about the horizontal axis. Furthermore, force derived from the control channels can be converted to rotation of carriages through other mechanical devices than those illustrated, such as a gear set. While I consider the following to be undesirable, seating also could rotate about their shafts in an uncontrolled manner by gravity. This arrangement may be improved by extending seating shafts into oil chambers and adding paddles to the shafts to slow the rotations thereof—a damping technique used in many devices in various fields.

Figure 17:
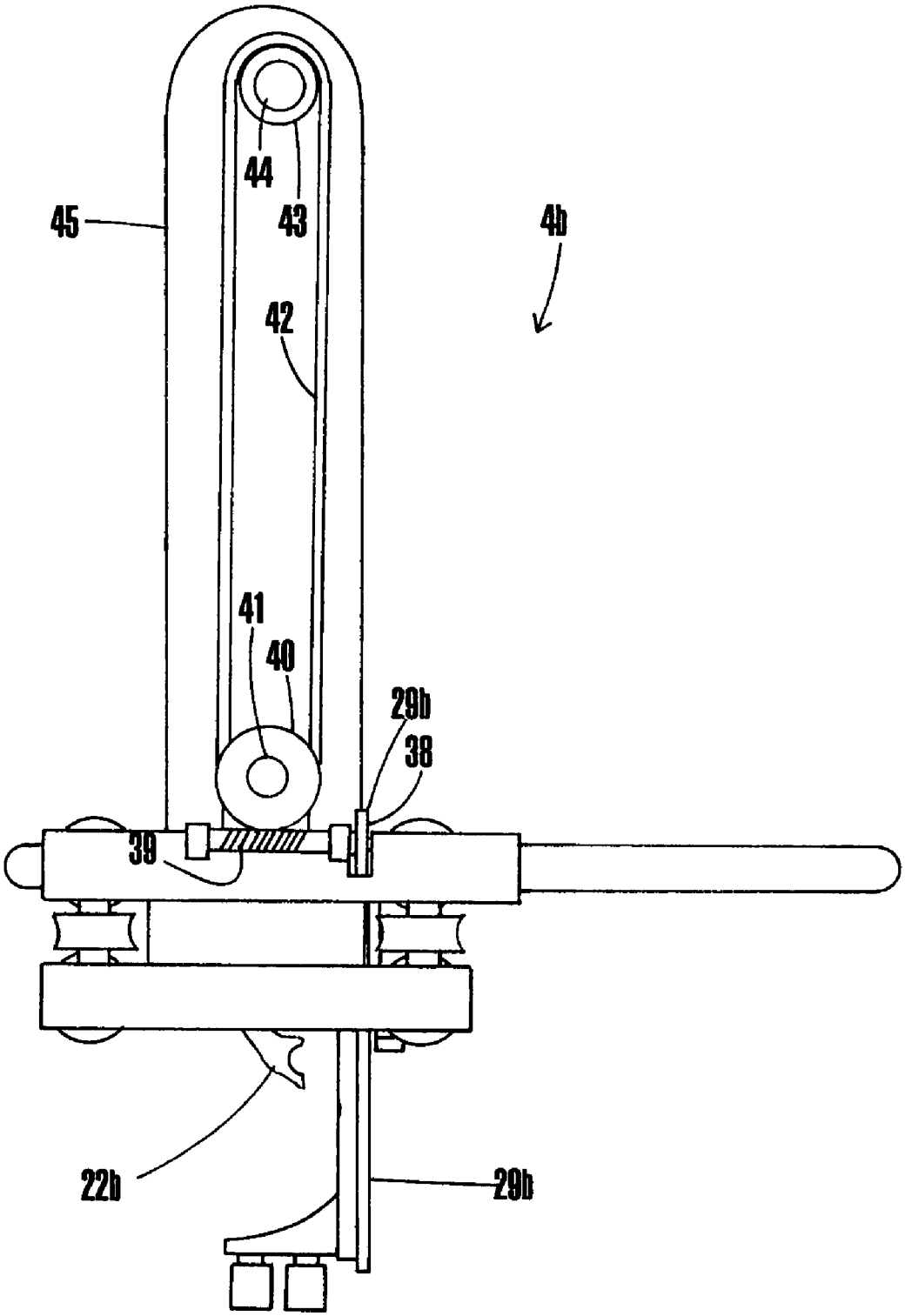
FIG. 17 is a rear view of a vehicle.
Figure 18:
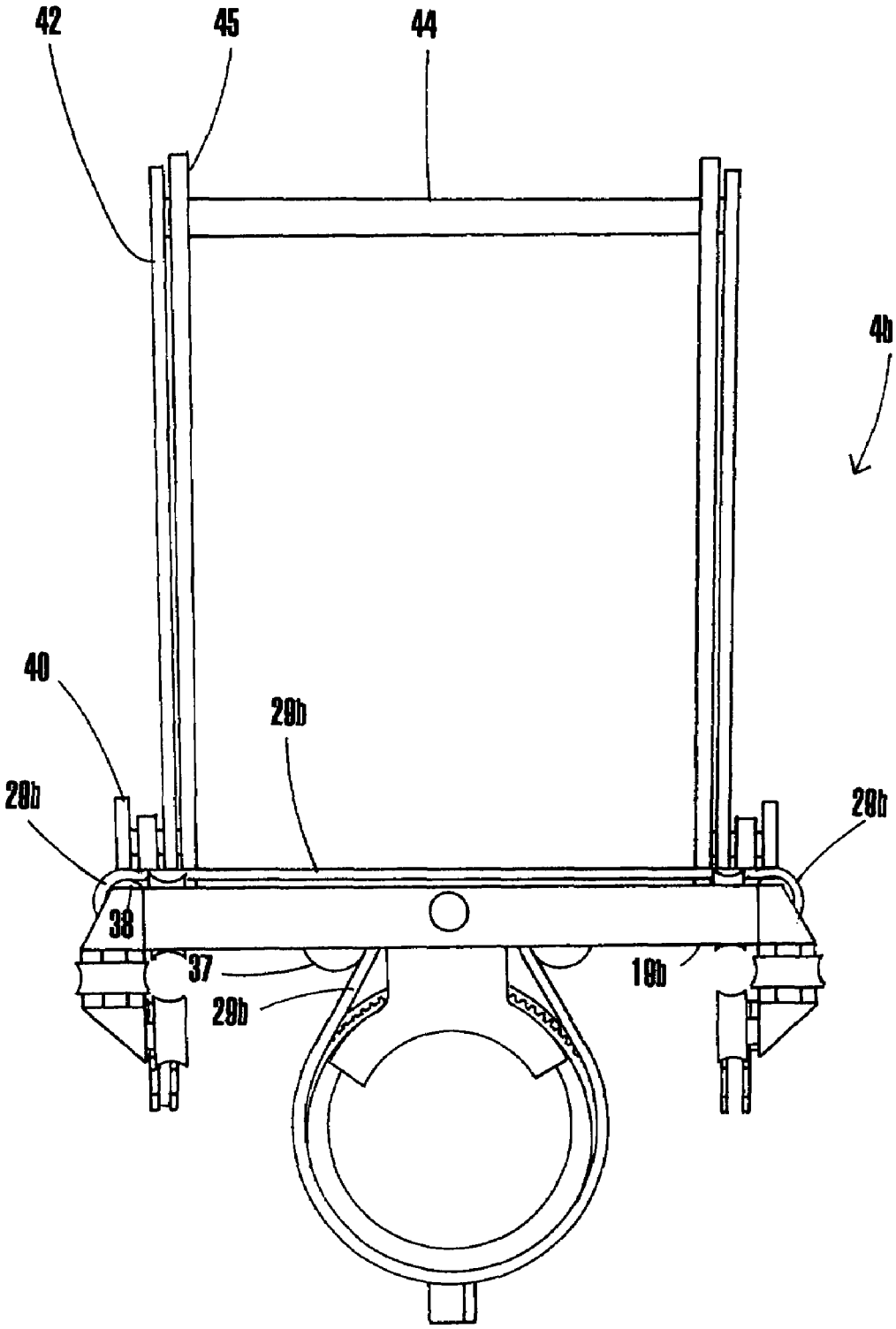
FIG. 18 is a side view of a vehicle.
Figure 19:
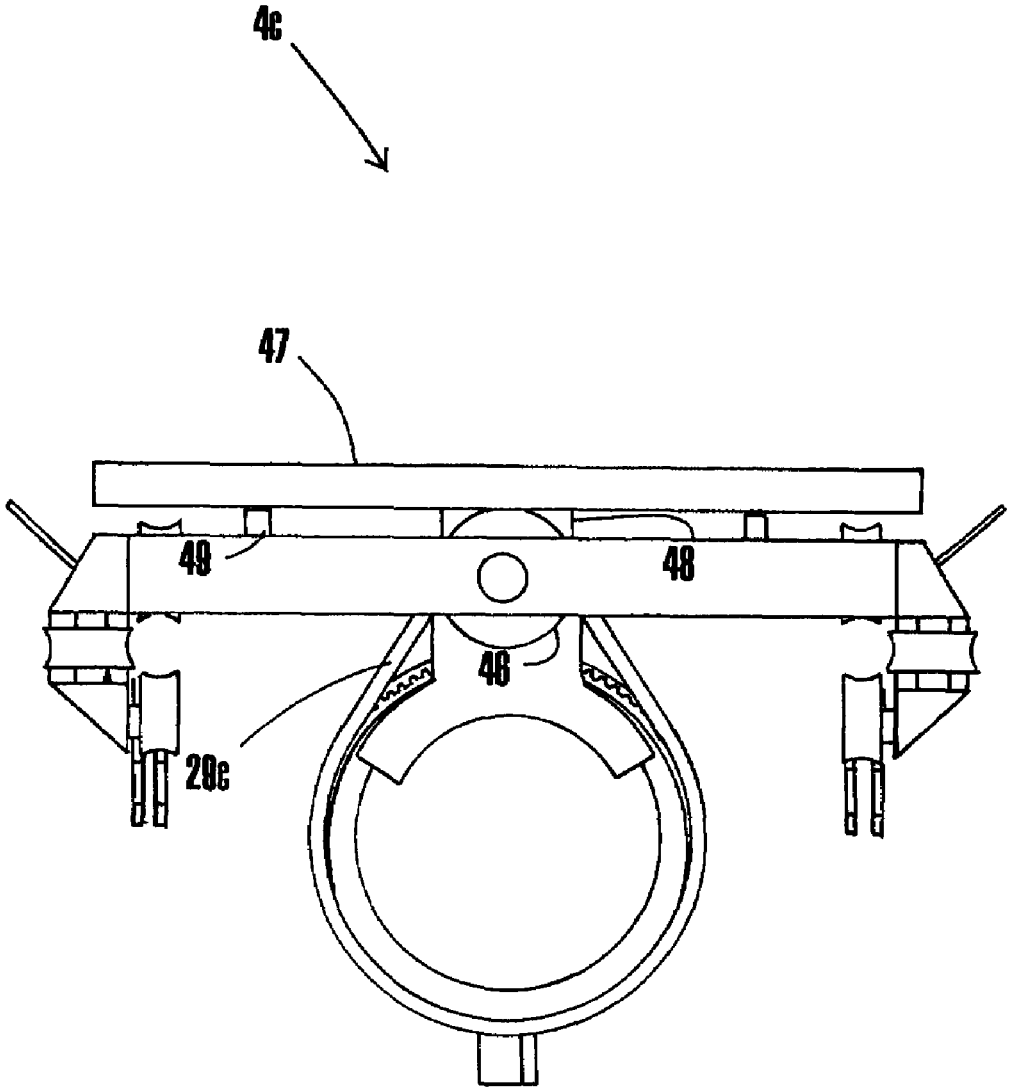
FIG. 19 is a rear view of a vehicle.

The technology in this disclosure could also be applied to induce rotations about axes other than the horizontal axis mentioned earlier. With reference to FIGS. 17 and 18, in this additional embodiment the vehicle 4*b* depicted includes primarily the same elements as vehicles in previous figures including a tow dog 22*b*. It is made to run on the same tracks systems previously described. However, elements of the vehicle 4*b* that are forced by the chain 29*b* to rotate are added or repurposed to cause rotation of a carriage (not shown) about an axis that is horizontal and perpendicular to the direction of travel. The chain 29*b* is routed over an idler gear 37 that is fixed into the base 19*b* and through a passage in the base 19*b* to allow it to avoid the track (not shown). The chain 29*b* would continue over another gear 38, the shaft thereof also being a worm gear 39. The worm gear 39 would force the rotation of a gear 40 on a shaft 41 that includes a gear (not shown) to drive another chain 42 which will then force the rotation of a gear 43 that includes a shaft 44 whereupon a carriage (not shown) would be fixed. The shaft 44 is maintained by strong upright supports 45. The chain 29*b* causes the rotation of matching elements on the other side of the vehicle 4*b*. The artisan may use common methods to construct the vehicle in this embodiment or a more efficient one that takes advantage of the novel track system. This embodiment would be well suited to a single track with a fairly consistent primary orientation or two tracks—one above a contiguous support and one below. In an additional embodiment illustrated in FIG. 19, a similar vehicle 4*c* is designed to convert rotation derived from the track system to rotation of a carriage about an axis that is vertical with respect to the track. The chain 29*c* rotates a gear (not shown) including a shaft (not shown) to which is affixed a gear 46 that will interact with gear teeth (not shown) on the underside of a sturdy, stable platform 47 to cause the rotation of it about a strong shaft 48 or similar arrangement. Such an arrangement might be made more stable with the addition of rollers 49 or similar elements such as a circular or semicircular track. A carriage would be fixed to the top of the platform. Similar additional embodiments would be apparent to the skilled artisan. Moreover, separate vehicles within a train could rotate their carriages on axes differing from other carriages within the train.

Parts of the invention may be eliminated if it is desired that a different result be achieved than in the first embodiment. For example, if the artisan desires that one or more of the three trains be of standard configuration as is known in the prior art, the rotation imparting constructions could be eliminated and the carriages could be fixed to the vehicles and the loading station could be altered accordingly. Furthermore, many elements of the invention could be altered if desired by the artisan as long as they achieve the same result. For example, a gear with a hub or shaft could replace the orbital gear under the base of each vehicle, even though doing so would likely sacrifice weight, aerodynamic, and aesthetic advantages. Also, the control channels could be replaced with rails or bars with tapered ends and the rollers could be placed on opposite sides of such rails. Such a change could be made while retaining inertia conservation, sound, and vibration advantages over prior art that uses toothed racks, pinion gears, cam followers, cam tracks, or the like. The artisan may select from various materials for the various parts of the embodiments keeping in mind that, with very few exceptions, all elements will need to have exceptional strength and stability. The dimension or arrangement of most of the elements of the invention, such as the length of vehicles, or number of carriages per vehicle, can be altered to some degree while still achieving the intended results.

Figure 20:
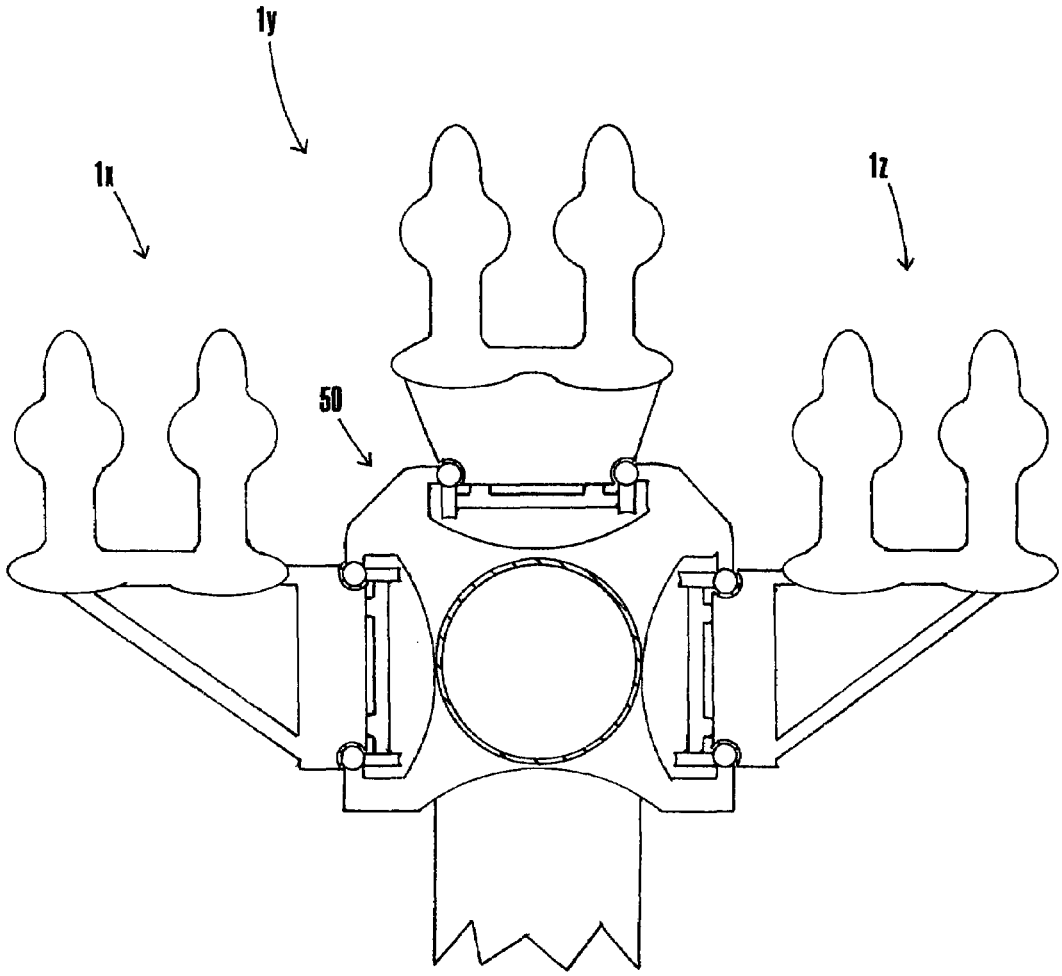
FIG. 20 is a rear view of trains, tracks, and a contiguous support.

An additional embodiment of the invention as depicted in FIG. 20 utilizes trains 1*x*, 1*y*, and 1*z* that are common in prior art on a novel track system 50 with merged support portions similar to those described above. With more than one, and possibly more than three tracks being supported in portions by one spine or equivalent supporting element, standard trains designed to ride on top of, on the sides of, or below the tracks could enjoy the same advantages as trains that rotate passengers with the exception of an "extra" dimension of movement and a few other important exceptions: Trains could not switch track orientation or placement for extended intervals, separate tracks could not be combined into one in the manner described above, and the loading station(s) would need to be modified accordingly.

While these embodiments are well suited to roller coasters, some of the embodiments may also be used in tower rides, flat rides, or other rides that do not form an endless track.

The invention, particularly the preferred embodiment, creates a unique and potentially thrilling experience that will likely not soon be forgotten by the passengers as well as advantages that will be appreciated by those who have to pay the potentially reduced cost of the invention.

While the above description contains many specificities, these should not be construed as limitations on the scope of the invention, but as exemplifications of the selected embodiments thereof. Many other ramifications and variations are possible within the teachings of the invention. Thus the scope of the invention should be determined by the appended claims and their legal equivalents, and not by the examples given.

I claim:

1. An amusement ride comprising:

a) at least one track including at least one stationary control structure, the position of said at least one stationary control structure being continuously variable and continuously equidistant relative to an axis that is parallel to said at least one track along the longitudinal extent of said at least one track;

b) at least one track supporting structure coupled to the at least one track in a contiguous arrangement to maintain the at least one track in predetermined orientations;

c) supporting elements for providing support to said at least one track supporting structure;

d) at least one carriage including seating for at least one passenger;

e) at least one vehicle rotatably coupling said at least one carriage to said at least one track for movement thereon; and f) at least one device for inducing rotation of said at least one carriage about a predetermined axis when a portion of said at least one device is force against and along said at least one stationary control structure by the forward motion of said at least one vehicle;

whereby the at least one passenger is translated along the complete path of said at least one track utilizing said forward motion of said at least one vehicle as the only motive force to rotate the at least one passenger independently of the orientation of said at least one track.

2. An amusement ride according to claim 1, wherein said at least one stationary control structure is a channel, slot, rail, or groove.

3. An amusement ride according to claim 1, wherein said predetermined axis is substantially parallel to the direction of travel of said at least one vehicle.

4. An amusement ride according to claim 3, wherein said at least one device comprises wheels, gears, and at least one chain.

5. An amusement ride according to claim 1, wherein said predetermined axis is substantially perpendicular to the direction of travel of said at least one vehicle.

6. An amusement ride according to claim 1, wherein said at least one track comprises multiple tracks, said multiple tracks being supported on a single said at least one track supporting structure for a portion of said ride.

7. An amusement ride according to claim 6, wherein said multiple tracks comprise two said tracks.

8. An amusement ride according to claim 6, wherein said multiple tracks comprise three said tracks.

9. A method for rotating passengers in an amusement ride comprising:

a) providing at least one track including at least one stationary control structure, the position of said at least one stationary control structure being continuously variable and continuously equidistant relative to an axis that is parallel to said at least one track along the longitudinal extent of said at least one track;

b) providing at least one track supporting structure coupled to the at least one track in a contiguous arrangement to maintain the at least one track in predetermined orientations;

c) providing supporting elements for providing support to said at least one track supporting structure;

d) providing at least one carriage including seating for at least one passenger;

e) providing at least one vehicle rotatably coupling said at least one carriage to said at least one track for movement thereon;

f) providing at least one device for inducing rotation of said at least one carriage about a predetermined axis when a portion of said at least one device is operatively engaged with said at least one stationary control structure; and g) translating said at least one vehicle along said at least one track thereby forcing said at least one device into and along said at least one stationary control structure, such that the at least one passenger is translated along the complete path of said at least one track utilizing said translation of said at least one vehicle as the only motive force to rotate the at least one passenger independently of the orientation of said at least one track.

* * * * *